US005529287A

United States Patent [19]

Pelosi, Jr. et al.

[11] Patent Number: 5,529,287

[45] Date of Patent: Jun. 25, 1996

[54] LIFTING DEVICE

[76] Inventors: Frank Pelosi, Jr.; Lee J. Pelosi, both of 32 Orchard La., Marlton, N.J. 08053

[21] Appl. No.: 297,019

[22] Filed: Aug. 29, 1994

[51] Int. Cl.[6] ..... B66F 3/00

[52] U.S. Cl. ..... 254/129; 254/130; 254/131; 254/133 R

[58] Field of Search ..... 254/8 R, 8 B, 254/8 C, 15, 17, 120, 129, 130, 131, 132, 133, 30

[56] References Cited

U.S. PATENT DOCUMENTS 3,203,668 8/1965 Pitsenbarger ..... 254/15
4,250,769 2/1981 Herring ..... 254/129
5,102,100 4/1992 Troncoso ..... 254/129
5,385,335 1/1995 Wurdock ..... 254/133

*Primary Examiner*—Robert C. Watson
*Attorney, Agent, or Firm*—Norman E. Lehrer; Jeffrey S. Ginsberg

[57] ABSTRACT

A device for lifting modular furniture comprising a base member, an elongated member pivotally connected to the base member and a furniture engaging portion rotatably mounted to one end of the elongated member. The furniture engaging portion includes a plate having a plurality of teeth extending from one end thereof for mating with slots in the modular furniture.

13 Claims, 3 Drawing Sheets

LIFTING DEVICE

BACKGROUND OF THE INVENTION

The present invention is directed toward a device for lifting modular furniture or the like and, more particularly, to such a device comprising a base member, an elongated member pivotally connected to the base member and a furniture engaging portion rotatably mounted to one end of the elongated member.

The use of modular furniture in office buildings has become quite common. It is utilized to conveniently create individual offices without requiring permanent walls. Modular furniture comprises a number of equally sized panels, each having a pair of hanging tracks secured to opposite sides thereof. Each hanging track includes a metal strip having a series of vertically coplanar elongated slots. Shelves, desks and the like are equipped with hooks that are designed to mate with the elongated slots.

The floor on which the furniture is placed is often covered with a number of carpet tiles. When the carpet tiles require replacement, the modular furniture has to be moved. This can be achieved by physically dismantling the furniture and moving the individual partitions from the area that has to be re-carpeted, laying down new carpet tiles and then returning the furniture to its original configuration.

A more efficient, cheaper and less disruptive way to recarpet the floor is to lift the partitions off the floor so that the old carpet tiles can be removed and new ones installed. This can be difficult since the individual partitions can be quite heavy. Accordingly, a number of devices have been developed to facilitate the lifting of this type of office furniture. See, for example, U.S. Pat. Nos. 4,846,443, 5,181, 694 and 5,234,197. A common drawback with the devices disclosed in each of these patents is that the lifting of the individual partitions is accomplished by inserting a bracket underneath the bottom of the partition and raising the bracket upward. Accordingly, a significant amount of force is placed on the partitions themselves. Since the base of the partitions are commonly made of plastic material, permanent deformation is a frequent occurrence.

U.S. Pat. No. 5,261,643 discloses a lifting device which comprises a jig attached to a conventional jacking mechanism. The jig includes a number of vertically coplanar hooks that are adapted to mate with slots in the furniture to be lifted. However, the hooks are not designed to accommodate the changing forces applied during the different stages of lifting. Moreover, the base member is not sufficiently spaced from the jig to avoid interference with the carpet tiles that are to be replaced.

SUMMARY OF THE INVENTION

The present invention is designed to overcome the deficiencies of the prior art discussed above. It is an object of this invention to provide a lifting device that can conveniently raise and lower office furniture without damaging the same.

In accordance with the illustrative embodiments, demonstrating features and advantages of the present invention, there is provided a lifting device comprising a base member, an elongated member pivotally connected to the base member and a furniture engaging portion rotatably mounted to one end of the elongated member. The furniture engaging portion includes a plate having a plurality of teeth extending from an end thereof and a plurality of notches formed adjacent the teeth. The teeth are adapted to engage the vertically coplanar slots located at the sides of the modular furniture. The lifting device further includes a lever extension telescopically secured to the underside of the elongated member for increasing the amount of leverage that can be applied when raising the modular furniture.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
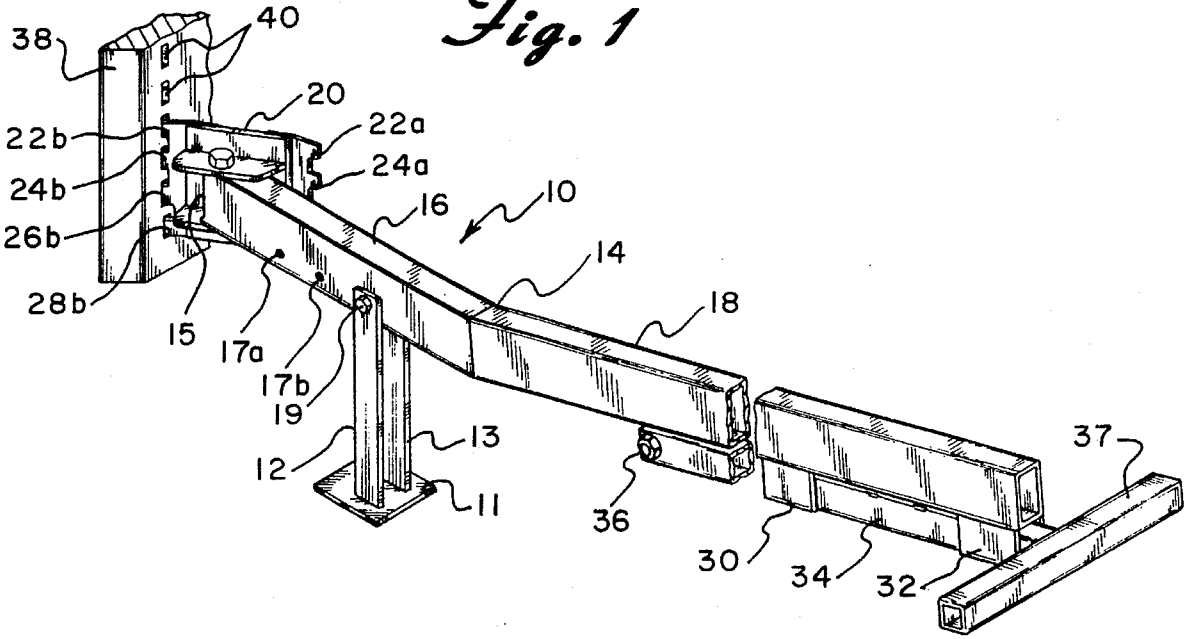
FIG. 1 is a perspective view of the lifting device showing the furniture engaging portion secured in the hanging tracks of a piece of modular furniture.

Referring now to the drawings in detail wherein like reference numerals have been used throughout the various figures to designate like elements, there is shown in FIG. 1 a lifting device constructed in accordance with the principles of the present invention and designated generally as 10.

The lifting device 10 comprises a base member 12 and an elongated member 14 pivotally secured to the top of the base member 12. The elongated member 14 includes a first section 16 and a second section 18. The first section 16 extends forwardly from the second section 18 and includes a first pair of side holes 17*a*, a second pair of side holes 17*b* and a third pair of side holes 17*c* formed therethrough The holes extend along the length of the first section 16 of the elongated member 14.

Figure 5:
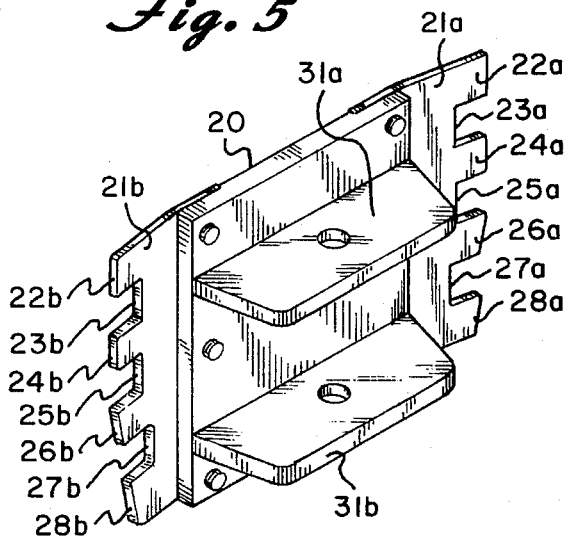
FIG. 5 is a rear perspective view of the furniture engaging portion.
Figure 6:
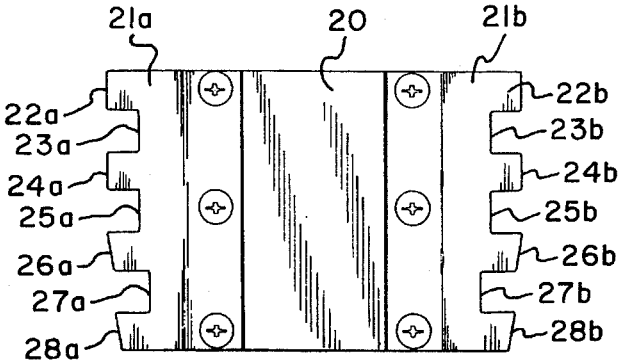
FIG. 6 is a front elevational view of the furniture engaging portion.

A furniture engaging portion 20 is rotatably secured to free end 15 of the first section 16 of the elongated member 14. In the preferred embodiment, the furniture engaging portion 20 includes right and left plates 21*a* and 21*b*, respectively, secured at opposite ends thereof. The right and left plates 21*a* and 21*b* are substantially identical to each other. Accordingly, only one of the plates will be described in detail, it being understood that the description applies equally to the other plate. Right plate 21*a* includes a plurality of teeth 22*a*, 24*a*, 26*a* and 28*a* and a plurality of notches 23*a*, 25*a* and 27*a* formed therebetween as illustrated in FIGS. 5 and 6. Notches 23*a* and 25*a* As can best be seen in FIGS. 6, 8 and 9, the uppermost tooth 22*a* or 22*b* on the plates 21*a* and 21*b*, respectively, extend further outwardly or forwardly than the lowermost tooth 28*a* or 28*b* lie in the same vertical line Notch 27*a* extends further into plate 21*a* than notches 23*a* and 25*a*.

The plate 21*a* is preferably curved to ensure sufficient insertion of the teeth in the slots 40 in the modular furniture 38. Moreover, the forward ends of the lower teeth 26*a* and 28*a* are preferably tapered as illustrated in FIGS. 5 and 6. The tapered teeth allow for increased engagement between the plate 21*a* of the furniture engaging portion 20 and the slots 40 formed in the furniture 38 for the reasons discussed below.

The furniture engaging portion 20 includes a pair of rearwardly extending horizontal plates 31*a* and 31*b*. A vertical pivot pin 33 extends through the horizontal plate 31*a*, the elongated member 14 and the horizontal plate 31*b*. The pin 33 functions as a vertical axis about which furniture engaging portion 20 rotates.

Figure 2:
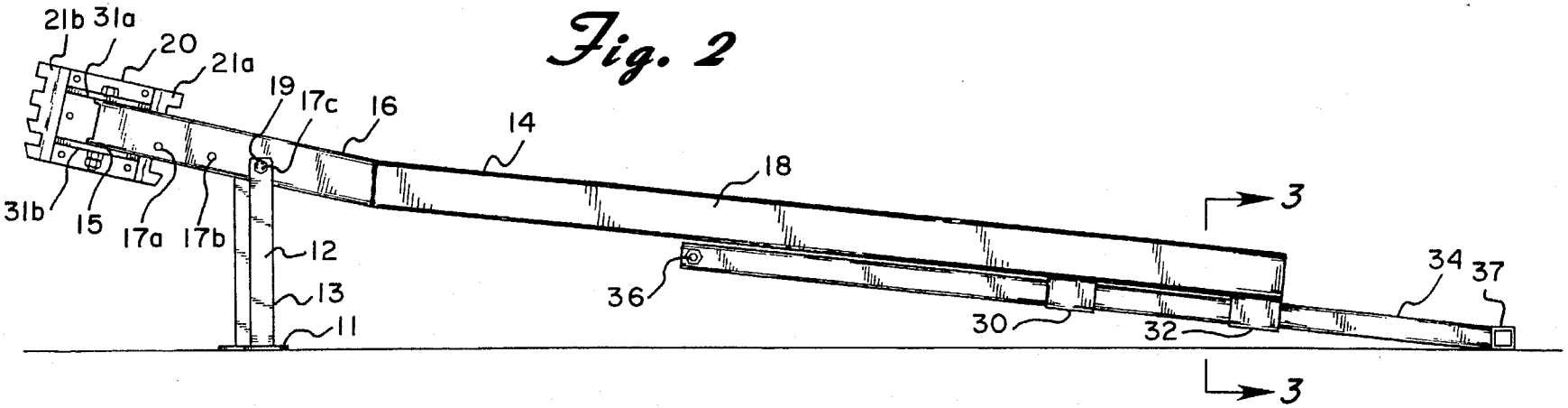
FIG. 2 is side elevational view of the lifting device.
Figure 3:
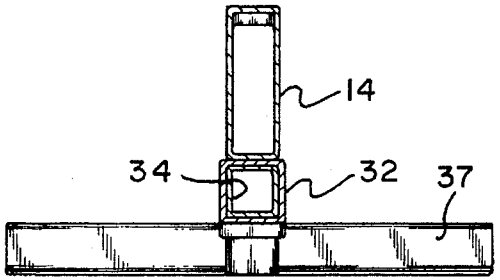
FIG. 3 is a cross-sectional view taken along lines 3—3 of FIG. 2.
Figure 4:
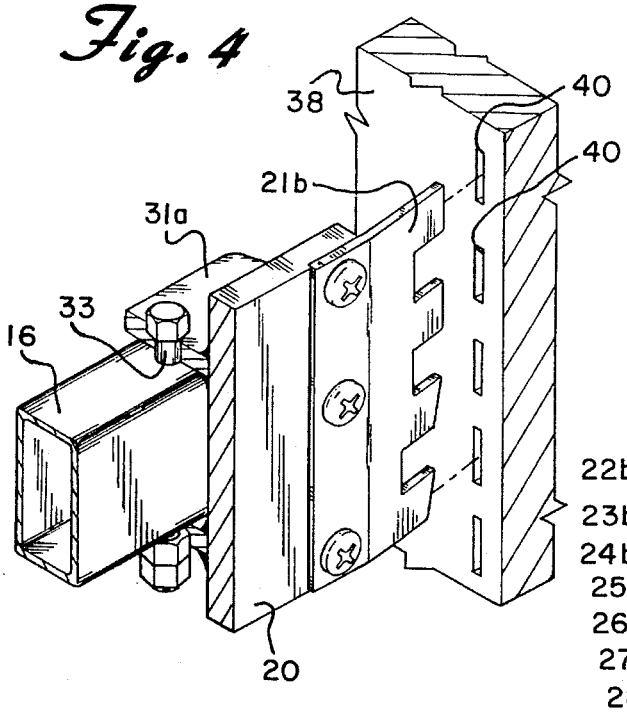
FIG. 4 is a perspective view of the furniture engaging portion aligned with the slots formed in a piece of modular furniture.

A pair of spaced brackets 30 and 32 are secured to the underside of the second section 18 of the elongated member 14 as shown in FIGS. 1 and 2. A lever extension 34 is telescopically mounted in the brackets 30 and 32. The lever extension 34 includes a transverse cross member 37 secured to one end. Stop guide 36 is secured adjacent the end of the lever extension 34 furthest from transverse cross member 37. When lever extension 34 is manually pulled away from base member 12 a predetermined distance, stop guide 36 contacts bracket 30 thereby preventing further removal of the lever extension. The stop guide 36 is preferably a screw threaded through the sides of the elongated member 14 and extending therefrom.

In the preferred embodiment, the base member 12 includes a ground support 11 and a channel member 13. The elongated member is pivotally secured to the top of channel member 13 by inserting rod or screw 19 through the channel member 13 and through a pair of side holes. The rod 19 acts as a horizontal axis about which the elongated member 14 rotates. The side holes allow the base member to be secured closer to or further from free end 15 of the first section 16 of elongated member 14. More specifically, if a heavy piece of furniture must be lifted and more leverage is needed, the base member 12 is pivotally secured through the side holes 17*a* so that it is closer to the furniture engaging portion 20. On the other hand, if a lighter piece of furniture is to be lifted the base member can be secured in side holes 17*b* or 17*c*. It is advantageous to distance the base member 12 from the furniture engaging portion 20 so that the base member does not interfere with the removal or installation of the carpet tiles.

To facilitate an understanding of the principles associated with the foregoing apparatus, its operation will now be briefly described. Either right plate 21*a* or left plate 21*b* is positioned adjacent slots 40 in the piece of furniture 38 depending on the location of the slots 40. Only the insertion of left plate 21*b* in slots 40 will be described in detail, it being understood that the description applies equally to the insertion of right plate 21*a* in slots 40. The teeth 22*b*, 24*b*, 26*b* and 28*b* extending from plate 21*b* are positioned adjacent slots 40 in a piece of furniture 38 to be lifted.

Figure 7:
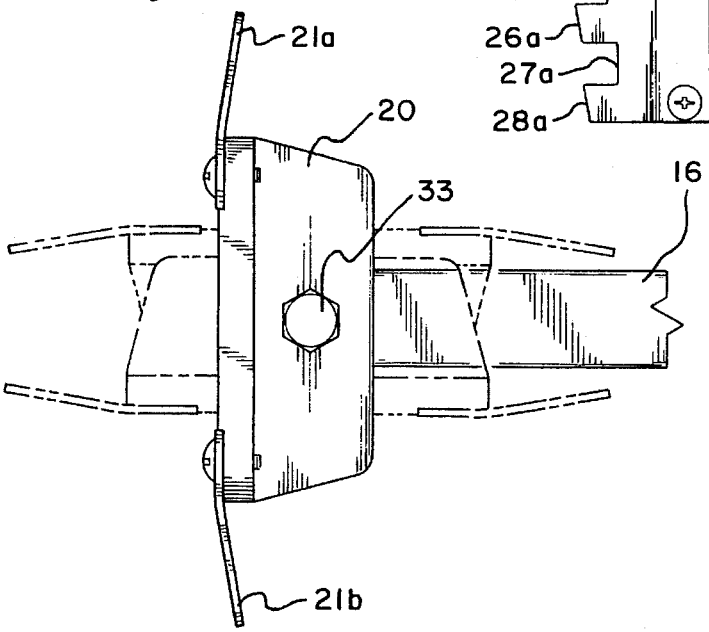
FIG. 7 is a top plan view of the furniture engaging portion.

Since the plate 21*b* is rotatably mounted to the end of elongated member 14 about vertical pivot pin 33, the furniture engaging portion 20 can engage the slots on a piece of furniture at a wide variety of angles (see FIG. 7). This is particularly advantageous as it is not always possible to insert the lifting device 10 straight into the slots in the furniture. During some carpet installations, for example, the device may have to approach the slots at an angle because of the specific configuration of the individual partitions or because of other obstructions. Accordingly, the furniture engaging portion 20 must be able to rotate so that the teeth can be properly aligned and inserted in the slots 40 in the piece of furniture to be lifted.

Figure 8:
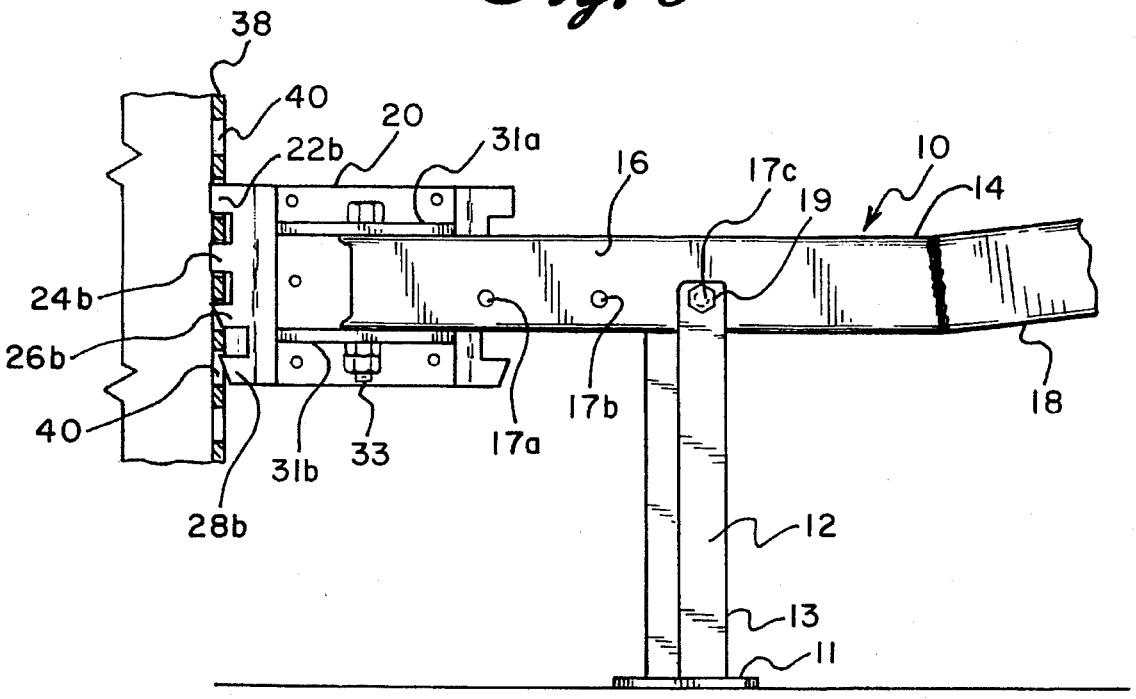
FIG. 8 is a side view of the lifting device showing the furniture engaging portion positioned in the slots of a piece of furniture to be lifted.
Figure 9:
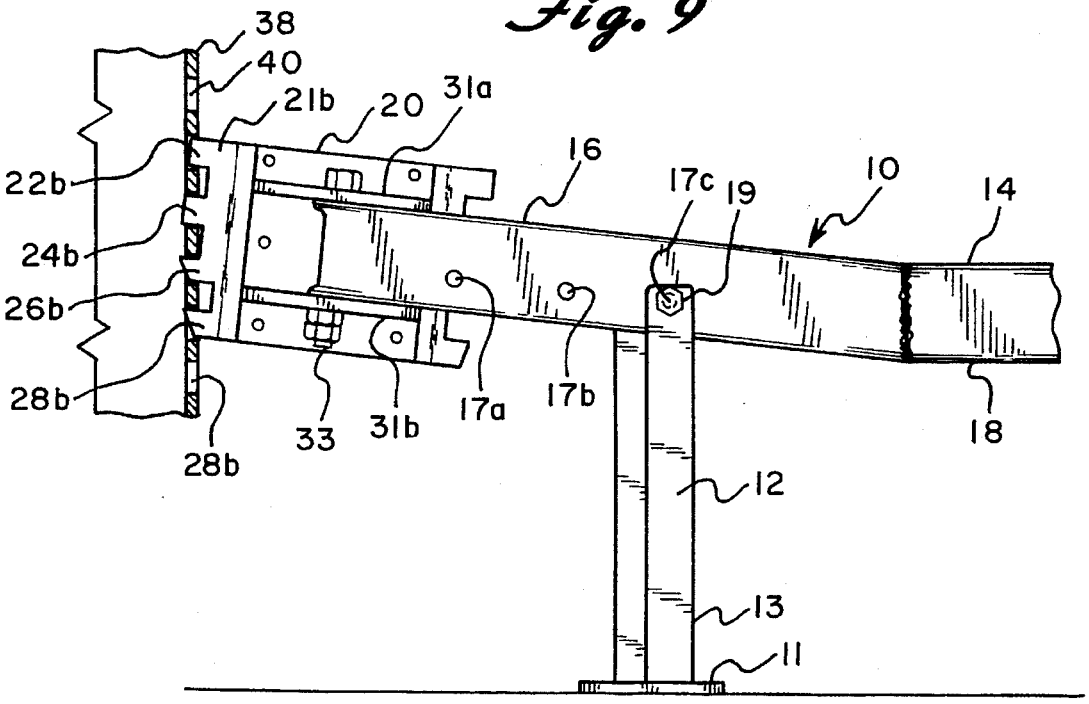
FIG. 9 is a side view of the lifting device showing the piece of furniture lifted by the furniture engaging portion.

Referring to FIGS. 8 and 9, the transverse cross bar 37 at the end of support 34 is slightly lifted off the ground thereby causing the furniture engaging portion 20 to move downward. The teeth 22*b*, 24*b*, 26*b* and 28*b* are then inserted into complimentary slots 40 in the furniture to be lifted as illustrated in FIG. 8. The curvature of the teeth facilitate the entry of the same into the slots 40. The teeth are sized so that the forward ends of teeth 22*b* and 24*b* are fully inserted in complimentary slots 40, while the forward ends of teeth 26*b* and 28*b* are partially inserted in the slots.

The cross bar 37 is then lowered and the furniture engaging portion 20 is raised. This causes teeth 22*b* and 24*b* to be partially removed from complimentary slots 40, while tapered teeth 26*b* and 28*b* are moved further into the slots. Teeth 26*b* and 28*b* are tapered so the bottom portion of these teeth does not cause the them to be disengaged from slots 40. More specifically, if teeth 26*b* and 28*b* were not tapered, the bottom portions of each of these teeth would press against the end of the modular furniture thereby forcing the teeth 22*b* and 24*b* out of their respective slots.

Notch 27*b* extends further into plate 21*b* so that tooth 28*b* can be inserted all the way into slot 40 without the end of the plate 21*b* pressing against the piece of furniture being lifted and thereby preventing sufficient insertion of the teeth 22*b*, 24*b*, 26*b* and 28*b* in corresponding slots 40. The lever extension 34 may be pulled from the brackets 30 and 32 to provide more leverage when heavier furniture has to be lifted.

The present invention may be embodied in other specific forms without departing from the spirit or essential attributes thereof and accordingly reference should be made to the appended claims rather than to the foregoing specification as indicating the scope of the invention.

We claim:

1. A device for lifting modular furniture comprising a base member, an elongated member pivotally connected to said base member about a horizontal axis and a furniture engaging portion mounted to one end of said elongated member, said furniture engaging portion including a plate extending from one end thereof, said plate having a plurality of teeth extending outwardly from an end thereof and a plurality of notches formed adjacent said teeth, said teeth being arranged vertically and being adapted to engage complimentary slots located in the modular furniture, said plurality of teeth including an uppermost tooth and a lowermost tooth, said uppermost tooth extending further outwardly than said lowermost tooth.

2. The device of claim 1 wherein said elongated member has a first section and a second section, said first section extending angularly upward from an end of said second section.

3. The lifting device of claim 1 wherein said furniture engaging portion has a pair of plates secured at opposite ends thereof, each of said plates having a plurality of teeth extending from an end thereof and a plurality of notches formed adjacent said teeth, said teeth being adapted to engage complimentary slots formed in the modular furniture.

4. The device of claim 3 wherein at least two of said notches in each of said plate are vertically aligned.

5. The device of claim 3 wherein said elongated member has a first section and a second section, and wherein said first section extends angularly upward from an end of said second section.

6. The device of claim 1 further including means for adjustably securing said base member to said elongated member so that said base member can be positioned closer to or further from said furniture engaging means.

7. The device of claim 1 further including a lever extension telescopically mounted to said elongated member.

8. The device of claim 7 wherein said lever extension is telescopically mounted to the underside of said elongated member.

9. The device of claim 7 further including a stop guide secured to said lever extension for preventing removal of said lever extension from said elongated member beyond a predetermined point.

10. A device for lifting modular furniture comprising a base member, an elongated member pivotally connected to said base member about a horizontal axis and a furniture engaging portion rotatably mounted to one end of said elongated member about a vertical axis, said furniture engaging portion having a pair of plates secured at opposite ends thereof, each of said plates having a plurality of teeth extending from an end thereof and a plurality of notches formed adjacent said teeth, said teeth being adapted to engage complimentary slots formed in the modular furniture.

11. The device of claim 10 wherein at least two of said notches in each of said plate are vertically aligned.

12. A device for lifting modular furniture comprising a base member, an elongated member pivotally connected to said base member about a horizontal axis, a furniture engaging portion rotatably mounted to one end of said elongated member about a vertical axis and a lever extension telescopically mounted to the underside of said elongated member.

13. A device for lifting modular furniture comprising a base member, an elongated member pivotally connected to said base member about a horizontal axis, a furniture engaging portion rotatably mounted to one end of said elongated member about a vertical axis, a lever extension telescopically mounted to said elongated member and a stop guide secured to said lever extension for preventing removal of said lever extension from said elongated member beyond a predetermined point.

* * * * *